United States Patent [19]

Weening et al.

[11] Patent Number: 5,029,431

[45] Date of Patent: Jul. 9, 1991

[54] METHOD AND APPARATUS FOR PACKING CONTAINERS

[76] Inventors: Frederick A. Weening, 35 Imperial Crescent, Bradford, Ontario, Canada, L3Z 2N8; Mark E. Curle, 18649 Yonge St., RR #1, Newmarket, Ontario, Canada, L3Y 4V8; John D. Long, 24 Finch Ave. East, Willowdale, Ontario, Canada, M2N 4R1

[21] Appl. No.: 465,444

[22] Filed: Jan. 16, 1990

[51] Int. Cl.[5] ..... B65B 5/10; B65B 57/06; B65B 57/20

[52] U.S. Cl. ..... 53/437; 53/54; 53/171; 53/244; 53/449; 53/475; 53/501; 53/506; 53/525

[58] Field of Search ..... 53/54, 171, 244, 248, 53/249, 250, 253, 260, 437, 449, 469, 475, 505, 506, 525, 501; 209/656

[56] References Cited

U.S. PATENT DOCUMENTS

| | | | |
|---|---|---|---|
| 1,900,907 | 3/1933 | Buxton | 53/244 X |
| 2,061,490 | 11/1936 | Thompson et al. | 53/244 X |
| 2,713,446 | 7/1955 | Vaughan | 53/244 X |
| 2,849,845 | 9/1958 | Prickett et al. | 53/244 X |
| 3,406,727 | 10/1968 | Rexus | 53/253 X |
| 3,619,968 | 11/1971 | Kapare | 53/469 X |
| 3,803,799 | 4/1974 | Mosterd | 53/260 X |
| 3,842,569 | 10/1974 | McClelland et al. | 53/469 |
| 4,027,458 | 6/1977 | Goodman | 53/505 X |
| 4,045,940 | 9/1977 | White et al. | 53/253 X |
| 4,050,218 | 9/1977 | Call | 53/244 X |

*Primary Examiner*—Robert L. Spruill
*Assistant Examiner*—Linda B. Johnson

[57] ABSTRACT

Apparatus for packing a number of small packages into containers of a larger size and having an inclined conveyor for receiving packages, a counter flat adjacent to upper end of the conveyor for generating count signals, a storage chute for receiving packages being angled downwardly, container holders located adjacent to the chute lower end adapted to hold container in registration with the chute lower end for receiving packages the holder means being intermittently operably whereby to move the container when it has received a predetermined number of said packages, and to place an empty container, in registration with the chute lower end, and, controls operable to cause intermittent movement of the holder in response to a predetermined number of count signals, and a method of packing packages on the apparatus.

16 Claims, 5 Drawing Sheets

METHOD AND APPARATUS FOR PACKING CONTAINERS

FIELD OF THE INVENTION

The invention relates to an apparatus for packing produce, and to a method of packing produce, wherein small packages of produce are counted, and placed in larger containers.

BACKGROUND OF THE INVENTION

Produce such as fruits for example, citrus fruits, and also vegetables such as onions, potatoes, beets and the like are often packaged in small packages, typically net bags, and these smaller packages are then in turn packed in larger containers also typically net bags. Quantities of produce in the smaller packages may vary, for example, onions may be packaged in either two pound or in five pound packages, and citrus fruits may be packaged usually according to the number of pieces of fruit in a given package size. For the sake of convenience in shipping and handling, these smaller packages are in turn packed in larger bags, which may contain for example in the region of fifty pounds of produce. These numbers are, of course, given merely by way of example, and without limitation.

The packing of the produce in the larger bags has, in the past been carried out by packing machines, in which the smaller packages of produce were fed by means of a conveyor, past a counter, and were then dropped one by one into the larger bag. Typically the larger bags were carried on some form of carriage such as a carousel, and when a predetermined count of smaller packages had been packed in a larger bag, the carousel or other carriage means moved, so as to register a fresh, unfilled bag with the conveyor. While the principle of these earlier machines was generally speaking acceptable, they suffered from a variety of defects. For example, the counting mechanism used in such machines frequently was based on some form of so-called electronic eye, or photo-sensitive device. Such a counting device would detect each of the smaller packages and register a count. However, during the operation of such machines, it sometimes occurrs that one of the smaller packages will become broken, leaving loose produce on the conveyor. When this occurred, the electronic eye type of counter or sensor would register a count for each individual item of produce, and consequently lead to a false count, so that the larger bag contained short weight.

Another problem that occurred with earlier machines was that sometimes the smaller packages of produce would not settle in the larger bag, so that the larger bag was unable to receive its full count.

Another problem with earlier machines was that when one bag was filled, and was being moved away from the conveyor, there was a slight delay between the moving of the full bag and the positioning of a new empty bag. During this time delay, either smaller packages of produce would continue to fall from the conveyor, or alternatively the conveyor had to be stopped and restarted. This lead to interruptions in the operation of the device, resulting in lost time and production.

Another problem with such earlier machines was that they were excessively long, and occupied too much space leading to inefficient use of the floor of the plant or warehouse where the machines were being operated.

Another problem with earlier machines, was that they were in many cases specifically designed for one particular function namely the packing of smaller bags of produce in larger bags. Produce in smaller bags is in some cases packaged in containers other than net bags, namely conventional cardboard cartons. However, many of the earlier machines were not adaptable to pack either in bags or in cartons, and consequently were not adapatable in use.

Clearly, it is desirable to provide an improved apparatus of the type described wherein these various problems are overcome in an efficient and reliable manner and also to provide an improved method of packing. An improved method of packing packages of a first predetermined size into containers of a second predetermined larger size.

BRIEF SUMMARY OF THE INVENTION

With a view to overcoming the various problems noted above, the invention comprises an apparatus for packing a predetermined number of packages of a first predetermined size into containers of a second predetermined size greater than said first size, said packages containing items, and comprising an inclined conveyor means defining lower and upper ends for receiving said packages and operable for moving same towards said upper end, counter flap means adjacent said upper end of said conveyor means for counting said packages and for generating count signals in response thereto, chute means for receiving said packages from said counter flap means, said chute means being angled downwardly towards a chute lower end, container holder means located adjacent to said chute lower end and adapted to hold a said container in registration with said chute lower end for receiving packages therefrom, said container holder means being intermittently operable whereby to move a said container when it has received a predetermined number of said packages, and to place an empty container, in registration with said chute lower end, and, control means operable to cause said intermittent movement of said container holder means in response to a predetermined number of said count signals.

More particularly, the invention provides apparatus having the foregoing advantages and including screen means located adjacent said upper end of said conveyor means, for screening loose items, whereby to prevent same from entering said chute means.

More particularly, the invention provides apparatus having the foreging advantages and wherein said counter flap means comprises a flap member, swingably mounted adjacent said upper end of said conveyor means, and biasing means biasing same into a predetermined position, said biasing means being adjustably controllable whereby to permit same to yield, and permit said flap to swing, in response to presence of a said package on said flap.

More particularly, the invention provides apparatus having the foregoing advantages and wherein said flap defines a free edge remote from said pivotal mounting, and including screen means located adjacent said free edge of said flap, said flap and said screen means defining a generally V-shaped recess for reception of said packages therein, from said upper end of said conveyor means.

More particularly, the invention provides apparatus having the foregoing advantages and including catcher means located adjacent said lower end of said chute means, and being swingably moveable between open and closed positions, and including power operated means for moving same from said open to said closed position, said control means sending a closure signal to said catcher means, whereby to momentarily close same while said container holder means is removing a filled container, and positioning an empty container in registration with said chute lower end.

More particularly, the invention provides apparatus having the foregoing advantages and including conveyor pocket means located adjacent said lower end of said conveyor, said pocket means being adapted to receive a said package, ready for engagement by said conveyor means.

More particularly, the invention provides apparatus having the foregoing advantages and including agitator means located in registration with, but spaced below, said lower chute end, and engageable with a said container when the same is located in registration with said chute lower end, and operable whereby to agitate said container while the same is receiving said packages from said chute means.

More particularly, the invention provides apparatus having the foregoing advantages and including sensing means for sensing the presence or absence of a container on said container holder means, and for generating a stop signal, and control means responsive to said stop signal to stop said conveyor means.

More particularly, the invention provides apparatus having the foregoing advantages and including motor means for operating said container holder means, clutch means connected to said motor, and gear drive means connected to said clutch means for intermittently transmitting motion from said motor means to said container holder means, and frictional drive means connecting between said clutch means and said container holder means, and being operable to slip, in the event of interference with said container holder means.

More particularly, the invention provides apparatus having the foregoing advantages and including container clamping arms incorporated in said container holder means, said container clamping arms being of generally semi-circular shape in plan, and being operable to wrap around and clamp the mouth of a said container, and locking means for locking said arms together in clamping relation, and pivotal mounting means for pivotally mounting said arms, for swinging away from and towards one another, and tooth gear means on both said arms interengaging with one another, whereby motion of one said arm is transmitted to the other arm as a simultaneous swinging motion thereof, in the reverse direction.

It is a further and related object of the invention to provide an apparatus having the foregoing advantages, and including releasable connection means for connecting said container holder means and said clutch means, whereby container holders may be interchangeable for containers for different types.

The invention also provides a method of packing items said items being packaged in packages of a predetermined size, said packages being adapted to be packed in containers of a predetermined larger size, said method comprising the steps of moving said packages on a continuously operating a conveyor whereby to cause said packages to move up along a conveyor path located at an inclination, from a lower end to the upper end thereof, dropping said packages one-by-one from the upper end of said conveyor onto counter flap means, each said package being adapted to operate said counter flap means whereby to procure a count signal for each package, passing said packages one-by-one from said counter flap means through package storage chute means, and into a container, closing said package storage chute means after a predetermined count of said packages have been deposited in said container, moving said container, and positioning a further empty container in registration with said storage chute means, opening said storage chute means, and depositing packages stored therein into said empty container.

More particularly, the invention provides a method having the foregoing advantages and including the steps of positioning a plurality of said containers on respective container support means, and progressively moving said container support means into position beneath said storage chute means for reception of packages therein, sensing the presence or absence of a container on a said container support means, and, shutting down operation of said conveyor in the event of a container absence signal being generated.

More particularly, the invention provides a method having the foregoing advantages and including the steps of sensing the presence or absence of a container holder means in registration with said storage chute means, and, opening said storage chute means, upon receipt of a container holder presence signal.

More particularly, the invention provides a method having the foregoing advantages and including the further step of continuously agitating said container while the same is in registration with said storage chute means, whereby to cause said packages in said container to settle.

The various features of novelty which characterizes the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
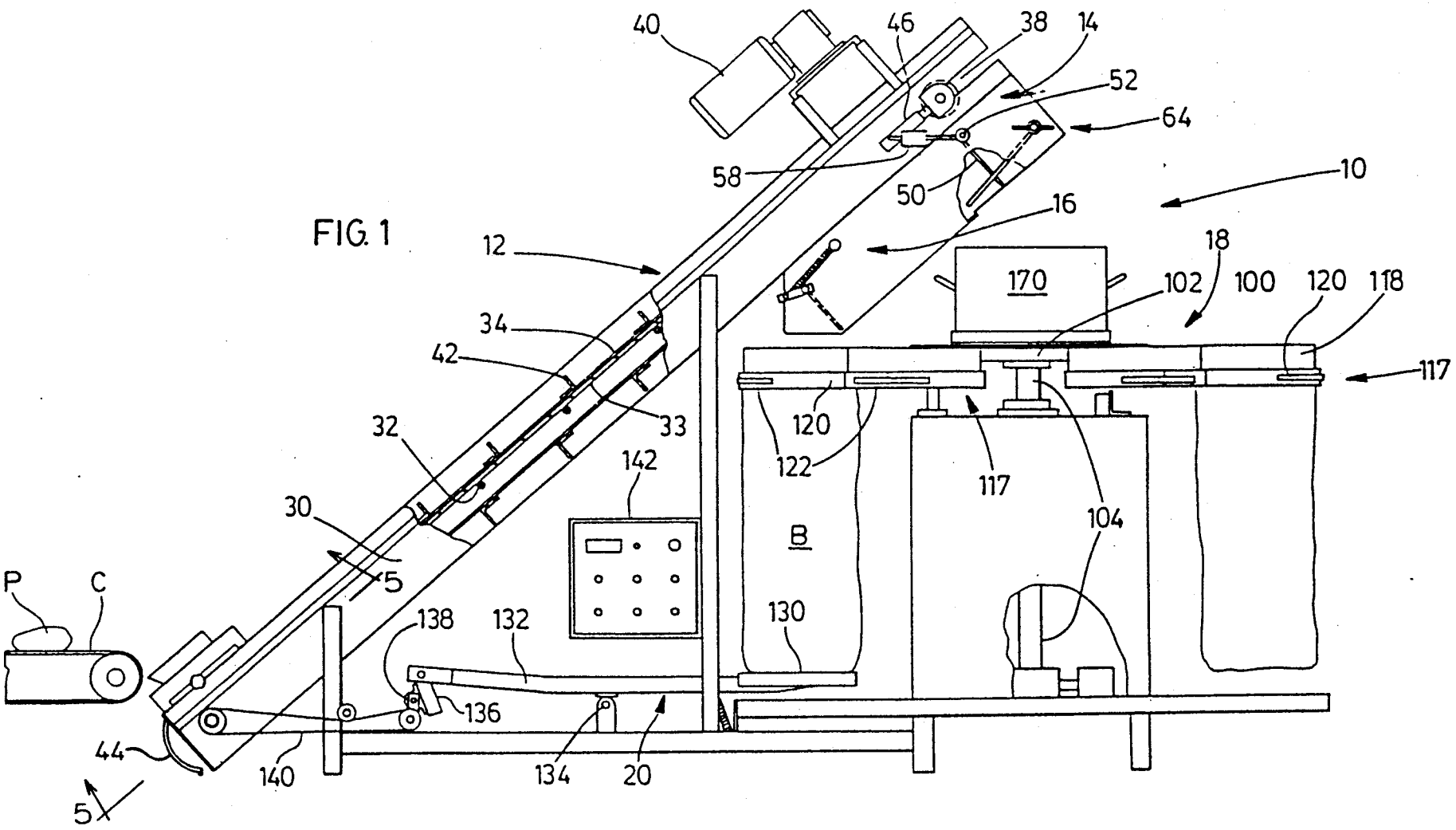
FIG. 1 is a side elevation of a packing apparatus in accordance with the invention.

Referring first of all to FIG. 1, it will be seen that what is illustrated there is a packing apparatus, which is in this particular case designed for packing smaller packages of onions. It will however, be understood that this example is given here merely by way of explanation of the invention, and the invention is in no way limited solely and exclusively to apparatus for packing onions, but either in its present form or with minor adjustments in dimensions, and control settings, as will be described below, the apparatus can be adapted for packing a variety of other produce items such as citrus fruits, and other vegetables for example, potatoes or the like. Wherever used, throughout this specification, the term "produce" is thus intended to be a generic term encompassing all types of produce that may be packaged and handled in this way. Furthermore, it will be appreciated that while the invention has particular application to produce items which are packaged loose in packages, it may have application to the packing of other small packages, whether the packages contain produce or any other items.

Onions, and other produce of this type, are frequently packaged and shipped in net containers or bags, and as explained above, such packages may be in individual customer sized volumes for example, two pounds, five pounds or the like. Such individual packages of produce are then packed in larger containers, such as larger net containers, typically holding for example, in the region of fifty pounds weight of produce, for convenience in shipping and storage. However, small packages of produce are also customarily packed in rectangular cartons, and the invention is equally applicable to packing in this type of carton, as will be apparent from the following description. Obviously, if the produce is individually packaged in two-pound packages, then a count of twenty-five such packages will fill a fifty-pound bag for shipping and storage. Similarly, if the individual produce packages contain five pounds of produce then a count of ten such packages will fill a fifty-pound bag. It will thus be understood that in the handling of this type of produce, packaged in this way, it is essential that an accurate repeatable count of the number of smaller packages of produce be achieved, in a manner which is as far as possible free of errors, so as to ensure that the larger containers contain the full count and thus the full weight of produce. Clearly, the same situation arises in connection with the shipment of other produce such as citrus fruits which in many cases are packaged by number rather than by weight.

The principal sub-assemblies of the apparatus will first of all be described, before describing the details.

Figure 8:
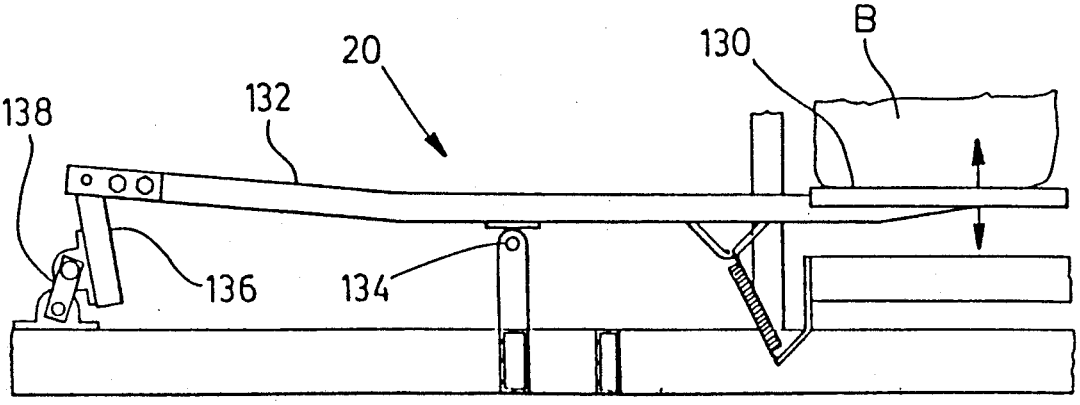
FIG. 8 is a side elevation of the shaker portion of the apparatus of FIG. 1.
Figure 4:
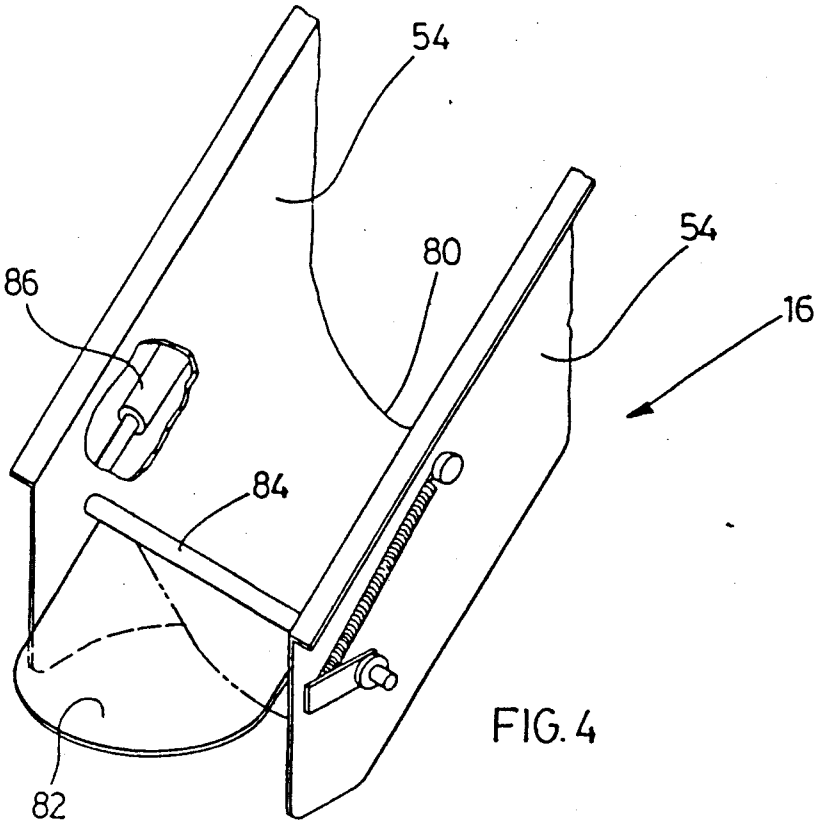
FIG. 4 is an enlarged perspective of a chute portion.

Referring again to FIG. 1, the apparatus is indicated by the general reference 10, and will be seen to comprise a conveyor assembly for elevating packages indicated as 12 (FIGS. 1 and 2), a counter assembly for counting the packages indicated by the general reference 14 (FIGS. 2 and 3), a chute assembly indicated by the general reference 16 (FIGS. 2 and 4), a carousel assembly indicated by the general reference 18 (FIGS. 1 and 6), and an agitator assembly indicated by the general reference 20 (FIGS. 1 and 8).

CONVEYOR ASSEMBLY

Referring now to FIG. 1, it will be seen that the conveyor assembly indicated generally as 12 comprises a pair of side frames 30—30, spaced apart from one another, and connected by cross braces 32. A conveyor belt 34 is supported on slide rails 33 and runs around roller 36 at the lower end and roller 38 at the upper end of the conveyor. Roller 38 is driven by any suitable means such as the motor gearbox combination 40. The roller 36 will typically be an idler roll. The belt 34 is continuous, and has a plurality of spaced apart pushers 42 secured thereon for pushing packages P up the incline of the conveyor.

At the lower end of the conveyor, there is provided a generally curved arcuate retaining plate 44, spaced outwardly from the conveyor, so as to permit free passage of the pushers 42, for reasons to be described below. Suitable tension adjusters are located at the lower end.

COUNTER ASSEMBLY

Figure 2:
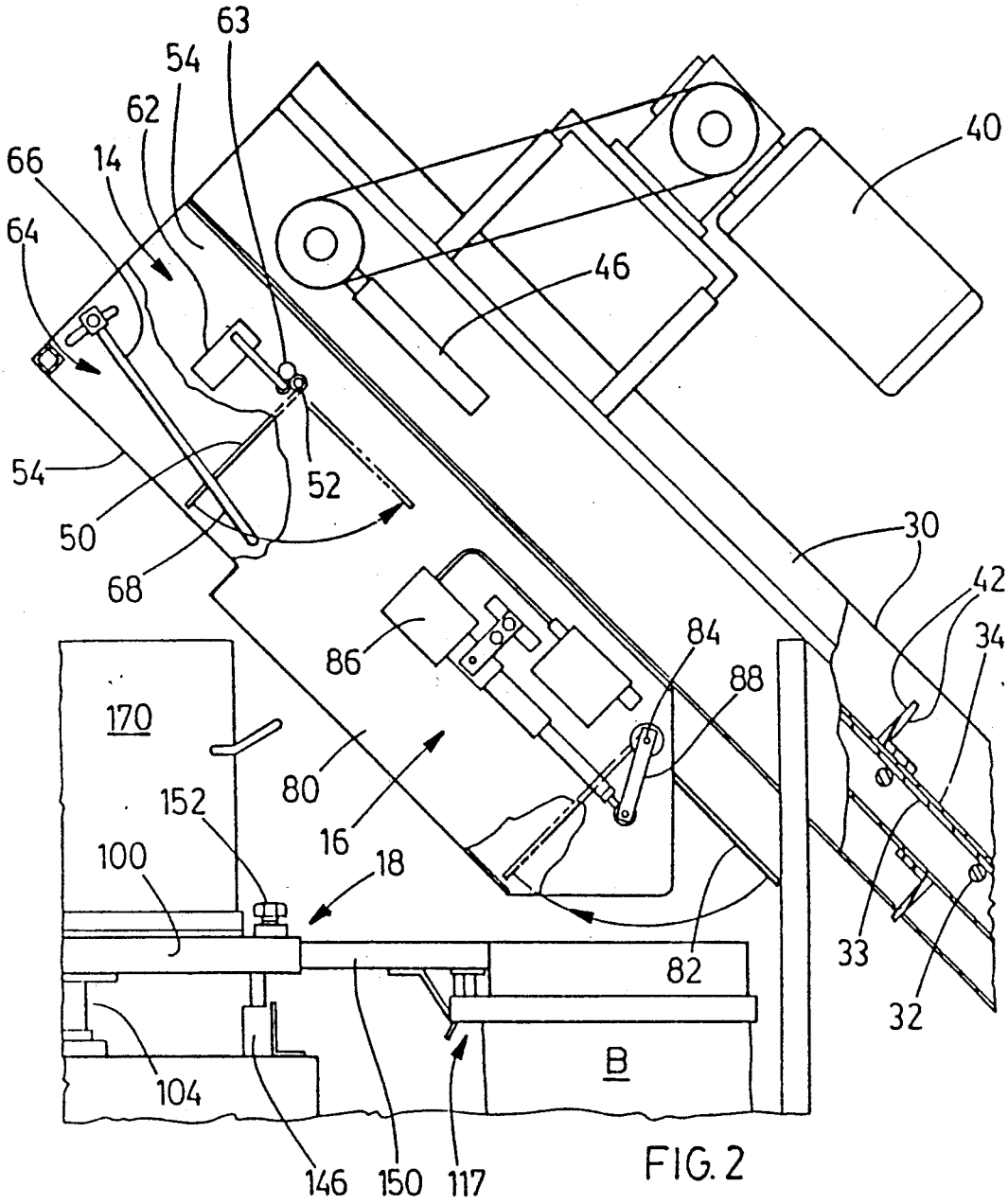
FIG. 2 is a side elevation of the apparatus shown in FIG. 1 from the opposite side.
Figure 3:
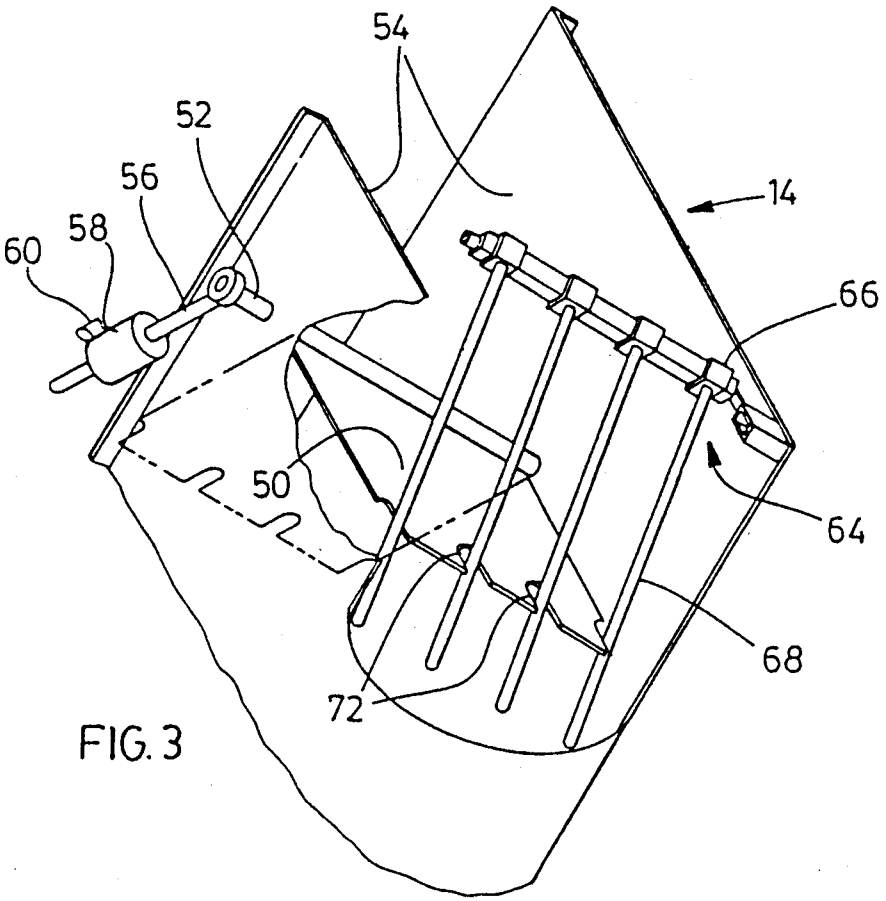
FIG. 3 is an enlarged perspective of a counter portion of the apparatus shown in FIG. 1.

The counter assembly 14 is located at the upper end of the conveyor, and is shown in more detail in FIGS. 2, and 3. It will be seen to comprise a counter flap plate 50, swingably mounted by shaft 52, which is, in turn, pivotally supported between side plates 54—54 located on the underside of the conveyor. One end of shaft 52 is provided with a generally L-shaped arm 56, and it is provided with a movable counter weight 58. A bolt 60 may be provided for locking the counter weight in the desired position on the arm.

The counter weight is designed and located so as to bias the flap into an angled position more or less 45 degrees or so to the vertical, the precise angling being unimportant.

The mass of the counter weight is designed to permit the counter flap to swing, when it is contacted by a package full of produce. However, if a single item or two or three loose items of produce land on the flap, the mass of the counter weight will prevent the flap from swinging.

At the opposite end, of shaft 52 a counter switch 62 is located on wall 54. Switch 62 is operated by cam 63 on shaft 52 to provide a count signal, each time the flap swings to release a package full of produce.

In order to discharge loose items such as loose items of produce from the surface of the counter flap, a screen 64 is mounted, also being supported between side walls 54—54. The screen consists of a cross member 66, and a plurality of rods 68 secured to the cross member and extending downwardly therefrom. Rods 68 are adjustably moveable along cross member 66 and maybe secured in position by screws (not shown). It will be noted that the screen is oriented at an angle, in this case of approximately 45 degrees, and the angle may be adjusted by means of the adjusting screws (not shown) on either side so as to optimize the angle for any particular package size of produce or other items. The rods 68 at their free ends are received in recesses 72 formed in the counter flap, in a form of interdigital engagement. The flap, and the screen make a generally V-shaped recess, when viewed in side elevation. Packages P falling from the upper end of the conveyor will thus be momentarily trapped or caught in this V-shaped recess, and assuming the package is of the appropriate weight, it will then cause the flap to swing, thereby allowing the package to slide off the end of the rods 68 of the screen.

CHUTE ASSEMBLY

The chute assembly indicated generally as 16 is essentially an extension of the side walls 54—54 of the counter assembly. Thus the chute assembly will be seen to comprise a generally U-shaped channel structure 80, secured to the underside of the conveyor, and extending parallel thereto, at the same angle as the inclination of the conveyor itself. The chute assembly defines upper and lower ends, and at the upper end, the rods 68 of the gate overlap the edge of the channel 80, so as to ensure that packages, falling on the gate, and operating the counter flap, will then be transmitted smoothly down into the chute.

At its lower end, the chute 80 is provided with a catcher flap 82. Catcher flap 82 is swingably mounted on by shaft 84, received in opposite sides of the chute 80. As best shown in FIG. 2, the catcher flap is power-operated, so that it may be opened and closed automatically in the manner described below. In this embodiment of the invention, such a power-operating system comprises an electric actuator 86, connecting with an operating arm 88, in turn connected to shaft 84. The catcher flap is normally open, and will be operated periodically in a manner to be described below. When the catcher flap is closed, and assuming the conveyor is continuing to run, then packages will be falling from the upper end of the conveyor, passing the counter flap, but will then remain trapped in the chute, until the catcher flap is then operated to open.

CAROUSEL

Figure 6:
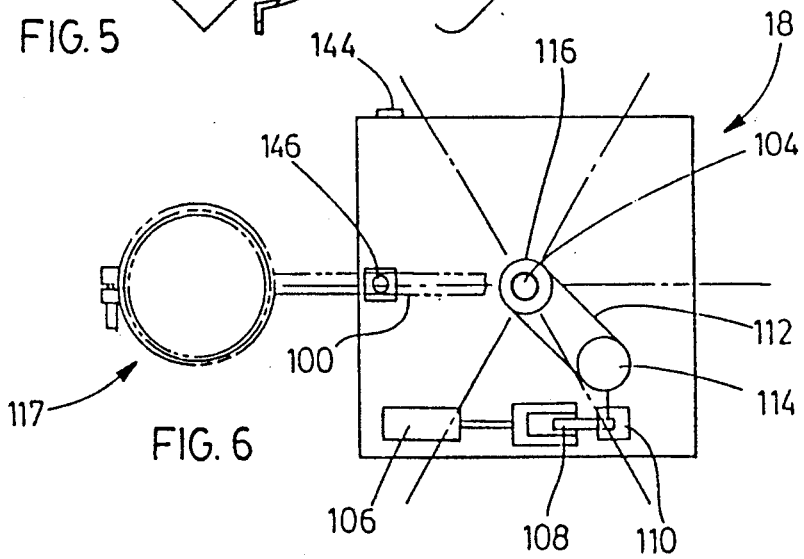
FIG. 6 is a schematic top plan (cut away) of a carousel portion.

The carousel, shown in FIG. 1 and also in FIGS. 6 and 8 comprises a plurality of radially-extending container holder arms 100, the containers in this case being net bags, mounted on a central hub 102. The hub 102 is, in turn, supported at the upper end of a shaft 104. The shaft 104 is adapted to be intermittently partially rotated, by means of an electric motor 106 and a clutch 108. The clutch 108 is connected to a gear box 110 which is in turn connected to the shaft by means of a V-belt 112 running in pulleys 114 and 116.

The motor is operated continuously, and the motion is communicated intermittently by means of the clutch, momentarily to cause a partial rotation of the shaft. The gear box acts as a brake when the clutch is released.

The use of a V-belt drive is intended to provide a stall feature in the drive mechanism so that if any of the arms is obstructed for some reason, the drive belt will simply slip.

At the outer ends of the bag holder arms, there are provided holder assemblies 117 having bag clamping means consisting of a ring 118 adapted to fit snugly in the open mouth of a bag, and a pair of bag clamping arms 120—120. Each of the arms 120 is of semi-circular shape, and is adapted to wrap around one half of the ring, thereby clamping the top of the bag securely to the ring.

Adjustable locking clamps 122—122 are located on respective arms 120, and are adapted to interengage and clamp the two arms tightly in position, with an overcentre action well known in the art, and may be manually released, so as to permit a filled bag to be removed.

For convenience in manual operation, it is desirable that the two clamping arms may be moved open or shut simultaneously, with one hand, while the bag itself is held with the other hand. In order to ensure a positive simultaneous movement of both arms, they are pivotally mounted at pivot points 124—124, and are interconnected by gear segments 126—126. This ensures that when one of the clamping arms is moved, to either open or close, the other arm will move simultaneously in the same way.

AGITATOR ASSEMBLY

The agitator assembly 20 as shown in FIGS. 1 and 8 will be seen to comprise an agitator plate member 130, mounted on one end of a rocking beam 132. The beam 132 is pivoted at about its mid-point on pivot 134. At its end remote from plate 130, an operating mechanism comprising a link 136 and a rotating crankshaft 138, are driven via chain 140, from idler roll 36 of the conveyor. In this way, the motor 40, through the drive medium of the conveyor belt 34, will drive the crankshaft 138, and thereby cause the plate 130 at the other end of the beam, to move upwardly and downwardly. The lower end of the bag B is of such a length that it will contact the surface of the plate 130, and thus as packages are deposited in the bag B, from the chute 16, the bag B is continuously agitated. In this way the packages will settle thereby facilitating the subsequent removal and tying of the containers.

All of the various functions of the apparatus are controlled via a control panel 142 which contains logic circuits for counting, and relays for controlling the various movements described above. Thus the count switch 62 is connected to the control panel 142, and the control panel 142 receives the count signals, counts them, and a suitable relay (not shown) and causes actuator 86 to close catcher flap 82. Adjuster relay causes clutch 108 to engage, which causes the sharft 104 to rotate through 60 degrees in this embodiment, although obviously if there were more or less arms 100 the rotation would be a different amount.

In order to control the apparatus, two further signals are required and these are provided by means of a bag detector 144 located on the carousel (FIG. 6) and arm movement sensor 146 also located on the carousel (FIG. 6).

Both sensors 144 and 146 are connected to the control panel 142. In the event that sensor 144 fails to detect a bag, on the arm 100, positioned adjacent to sensor 144, then sensor 144 transmits a bag absence signal to control panel 142. Panel 142 thereupon shuts down the entire apparatus, while the operator places a bag in position.

The sensor 146 responds to the presence of an arm in registration with the lower end of the chute 16. Once it detects the presence of such an arm, it sends an arm presence signal to the control panel 142 which thereupon signals clutch 108 to disengage.

Note however, that in normal operation the motor 40 runs continuously, so that the operation of the conveyor is continuous. This will result in two or three packages P falling off the conveyor, passing the counter flap 50, and then being stored in the chute. These packages will, of course, be counted by the counter logic in control panel 142. By the time the next arm 100 registers with the sensor 146, there may be two or three such packages stored in the chute, and already counted. As soon as the sensor 146 detects an arm it sends an arm presence signal to the control panel 142 which thereupon signals actuator 86 to open the catcher flap 82. The packages located in the chute at the time will all then be deposited in the bag, having previously been counted. It will thus be seen that in normal operation the conveyor can be operated continuously, without stopping and starting each time a bag is filled. This considerably speeds up the entire operation and also reduces stress on the operators.

In the event that a package P becomes broken and loose items are present on the conveyor, then they will, of course, be deposited on the counter flap 50, but being of insufficient weight the counter flap 50 will not operate, and the loose items can then pass freely between the rods 68 of the screen 64. Note that screen 64 having rods of different sizes or of different spacings may be provided for different types of items or produce, and the spacing of the recesses 72 in the catcher flap 50, may also be required to be readjusted to correspond.

Figure 5:
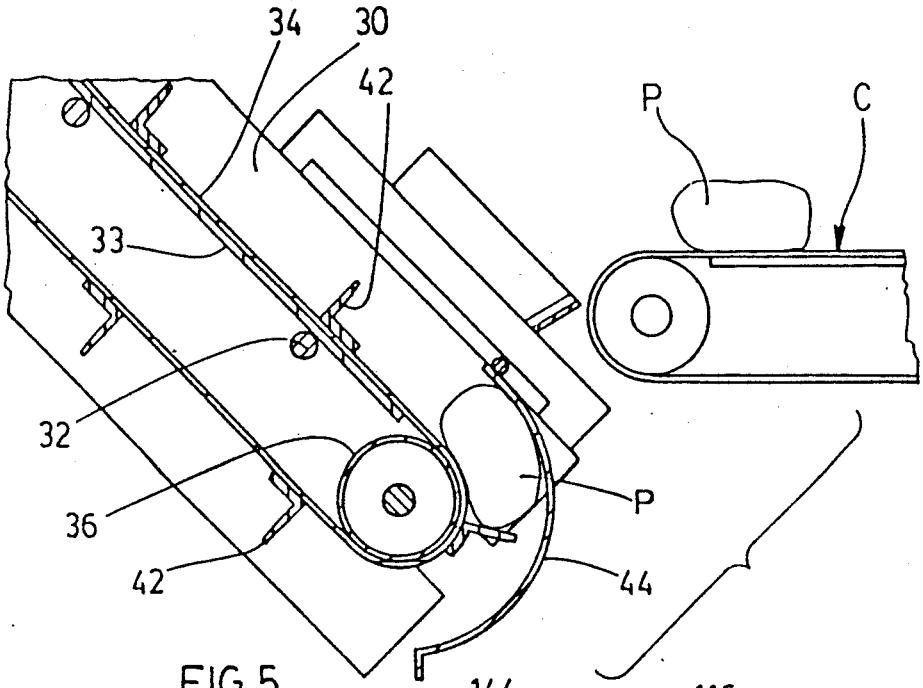
FIG. 5 is a section along the line 5—5 of FIG. 1.

The function of the retaining wall 44 is to permit packages to be placed on the conveyor, from an adjacent conveyor indicated as C in FIG. 5. The conveyor C would normally be conveying packages, from another form of packaging apparatus, provided by others. It is desirable that such a conveyor C shall be located on the floor as low as possible, in order to facilitate movement of operators around the two machines. The retaining plate 44 permits a package P to drop onto the conveyor, and slide, as it were, backwards part-way around the plate 44, until it is caught by the next pusher 42, as shown in FIG. 5.

Figure 7:
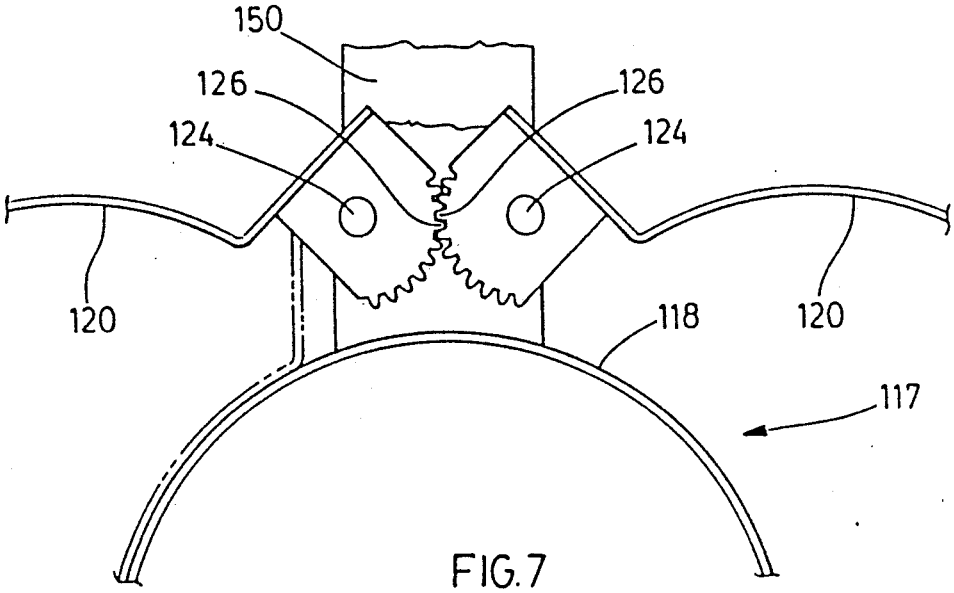
FIG. 7 is a schematic plan view of a bag clamp portion.
Figure 9:
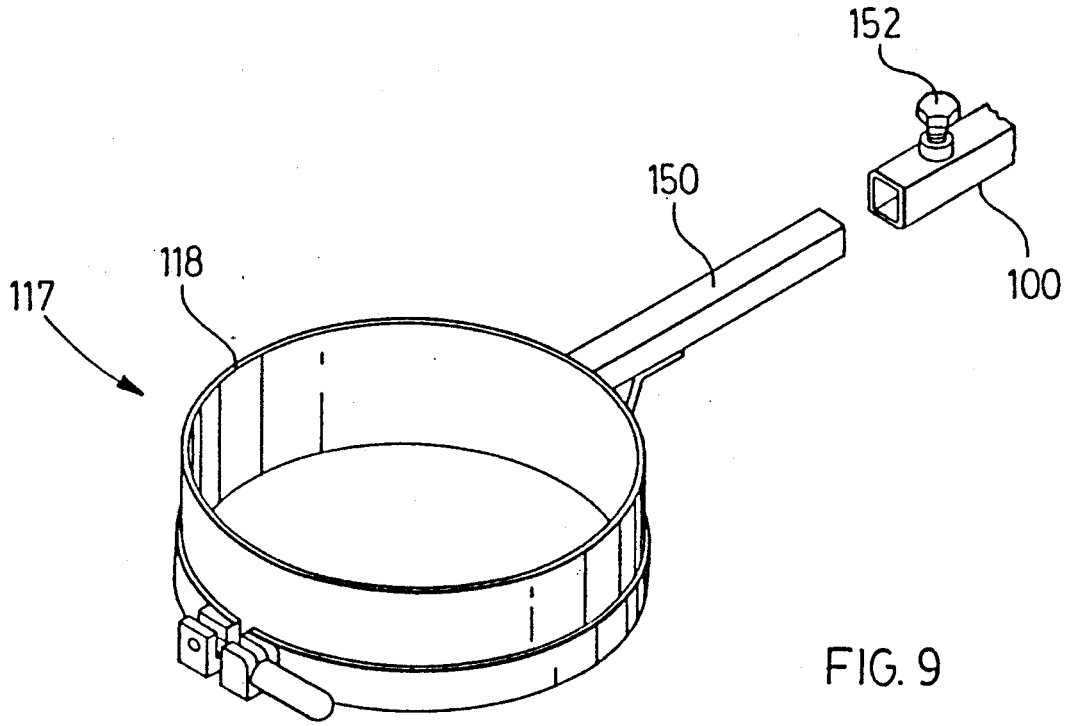
FIG. 9 is a perspective of a detail of the bag holder attachment used in the carousel, and, FIG. 10 is a perapective detail of an alternate form of container holder, suitable for use with cardboard cartons.
Figure 10:
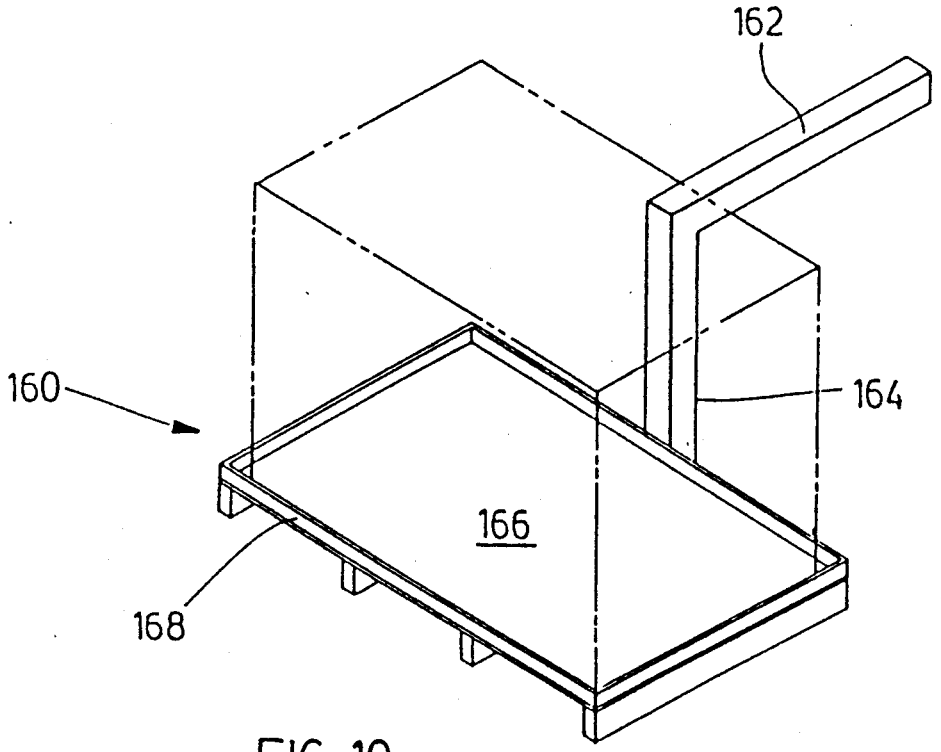

As best shown in FIGS. 9 and 10, the container holders 117 shown in FIG. 1 and 7 are specifically designed for use with bags, so that the open mouth of the bag can be drawn onto the ring and clamped in position.

Since bags come in different sizes it will be noted that the holder assemblies 117 are removeably secured to arms 100, by means of stub shafts 150, which make a telescopic sliding fit with arms 100, and maybe secured in position by means such as bolts 152.

In this way holder assemblies 117 maybe provided with rings 118 in various different sizes, so as to make the entire apparatus adaptable to packing in containers of different capacities.

In accordance with a further embodiment, the apparatus may also be adapted for packing packages in rectangular cartons such as the conventional cardboard packing cases. In this case, an alternate form of container holder 160 is provided (FIG. 10). Holder 160 comprises a stub shaft 162 adapted to be received and secured in the arm 100 of the carousel. An L-shaped leg 164 extends downwardly from shaft 162, and supports a suitable platform means 166. A retaining edge flange 168 is provided around platform 164, to receive a carton, and to secure it thereto while the carton is on the carousel.

Since it is anticipated during operation of the apparatus, that there will be at least some broken smaller packages, so that there will be some loose items lying on the conveyor car, means may be provided for collecting such loose items such as the bucket 170 located directly beneath the screen, and standing on top of the carousel. In this way loose items may be collected, and may periodically be removed for repacking in smaller packages.

Although not specifically illustrated, it will be appreciated that for example when packing small packages in a rectangular container, it may be desirable to make provision on the carousel, that any one rectangular container may be positioned in two or more different positions relative to the chute lower end. This may be achieved through the counter logic and clutch, and provision may be made with for example two sensors, to cause the arm to index from a first position to a second position and so on. In this way, the smaller packages will simply be deposited in the container at a first position and then at a second position and so on if necessary, so that they become well settled and correctly positioned in the container. The details of such mechanisms are believed to be self evident and are omitted for the sake of clarity, and could any event be achieved with the apparatus and configuration illustrated.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Apparatus for packing a predetermined number of packages of a first predetermined size into containers of a second predetermined size greater than said first size, said packages containing items, said apparatus comprising:

an inclined conveyor means defining lower and upper ends for receiving said packages and operable for moving same towards said upper end;

a counter flap member swingably mounted adjacent said upper end of said conveyor means for counting said packages and for generating count signals in response thereto;

a swingable mounting for mounting said counter flap member on said conveyor means;

biassing means biassing said counter flap member into a predetermined position;

screen means located adjacent said upper end of said conveyor means, for screening loose items, whereby to prevent same from entering said chute means;

a free edge on said flap member remote from said swingable mounting, said screen means being located adjacent said free edge of said flap member and said flap member and said screen means defining a recess for reception of said packages therein, from said upper end of said conveyor means;

chute means for receiving said packages from said counter flap member, said chute means being angled downwardly towards a chute lower end;

bag holder means located adjacent to said chute lower end and adapted to hold a said bag in registration with said chute lower end for receiving packages therefrom, said bag holder means being intermittently operable whereby to move a said bag when it has received a predetermined number of said packages, and to place an empty bag, in registration with said chute lower end, and, control means operable to cause said intermittent movement of said bag holder means in response to a predetermined number of said count signals.

2. Apparatus as claimed in claim 1 wherein said biasing means is adjustably controllable whereby to permit same to yield, and permit said flap member to swing, in response to presence of a said package on said flap.

3. Apparatus as claimed in claim 1 including catcher means located adjacent said lower end of said chute means, and being swingably moveable between open and closed positions, and including power operated means for moving same from said open to said closed position, said control means sending a closure signal to said catcher means in response to said predetermined number of said count signals, whereby to momentarily close same while said bag holder means is removing a filled bag, and positioning an empty bag in registration with said chute lower end.

4. Apparatus as claimed in claim 1 including conveyor pocket means located adjacent said lower end of said conveyor, said pocket means being adapted to receive a said package, ready for engagement by said conveyor means.

5. Apparatus as claimed in claim 1 including agitator means located in registration with, but spaced below, said lower chute end, and engageable with a said bag when the same is located in registration with said chute lower end, and operable whereby to agitate said bag while the same is receiving said packages from said chute means.

6. Apparatus as claimed in claim 1 including sensing means for sensing the presence or absence of a bag on said bag holder means, and for generating a stop signal, and control means responsive to said stop signal to stop said apparatus.

7. Apparatus as claimed in claim 1, and including motor means for operating said bag holder means, clutch means connected to said motor, and a reduction gear connected to said clutch means for intermittently transmitting motion from said motor means to said bag holder means, and frictional drive means connecting between said reduction gear and said bag holder means, and being operable to slip, in the event of interference with said bag holder means.

8. Apparatus as claimed in claim 1 including bag clamping arms incorporated in said bag holder means, said bag clamping arms being of generally semi-circular shape in plan, and being operable to wrap around and clamp the mouth of a said bag, and locking means for locking said arms together in clamping relation, and pivotal mounting means for pivotally mounting said arms, for swinging away from and towards one another, and tooth gear means on both said arms interengaging with one another, whereby motion of one said arm is transmitted to the other arm as a simultaneous swinging motion thereof, in the reverse direction.

9. Apparatus as claimed in claim 3 and further including holder sensing means for sensing the presence of a holder in registration with said chute lower end, and connected to said control means, said control means in turn being responsive to a holder presence signal, whereby to cause said catcher means to open.

10. Apparatus as claimed in claim 1, and wherein said bag holder means comprises a central shaft mounted for rotation on a vertical axis and power operated means for intermittently rotating same, and a plurality of arms extending radially therefrom, and container holder assemblies releasably secured to said arm.

11. Apparatus as claimed in claim 10, and wherein said container holder assemblies comprise shaft portions adapted to be received in respective said arms, and platform means located in a plane beneath said shaft, and container retaining means on said platform means, whereby containers may be positioned thereon for registration with said lower chute end.

12. Apparatus as claimed in claim 1, and wherein said screen means comprises a support cross member, adapted to be secured adjacent and beneath said conveyor upper end, and rod means secured to said cross member, in spaced apart relation to one another, and adjustable means securing said rod means to said support cross member whereby the same may be moveably positioned there along for screening items of different sizes.

13. A method of packing items, said items being packaged in packages of a predetermined size, said packages being adapted to be bagged in containers of a predetermined larger size, said method comprising the steps of;

continuously operating a conveyor means whereby to cause said packages and intermittent loose package items to move up along a conveyor path located at an inclination, from a lower end to an upper end thereof;

dropping said packages one-by-one from said upper end of said conveyor means onto a counter flap member, each said package being adapted to operate said counter flap member whereby to procure a count signal for each package;

dropping said loose package items from the upper end of said conveyor means onto said counter flap member, said loose items being incapable of operating said counter flap member, and passing said loose items through screen means, whereby to prevent said loose items from passing said counter flap member when the same is operated by a said package;

passing said packages one-by-one from said counter flap member through package storage chute means, and into a bag;

closing said package storage chute means after a predetermined count of said packages have been deposited in said bag;

moving said bag, and positioning a further empty bag in registration with said storage chute means;

opening said storage chute means, and, depositing packages stored therein into said empty bag.

14. Method as claimed in claim 13 including the steps of positioning a plurality of said bags on respective bag support means, and progressively moving said bag support means into position beneath said storage chute means for reception of packages therein, sensing the presence or absence of a bag on a said bag support means, and, shutting down operation of said conveyor in the event of a bag absence signal being generated.

15. Method as claimed in claim 14 and including the steps of sensing the presence or absence of a bag holder means in registration with said storage chute means, and, opening said storage chute means, upon receipt of a bag holder presence signal.

16. Method as claimed in claim 15 including the further step of continuously agitating said bag while the same is in registration with said storage chute means, whereby to cause said packages in said bag to settle.

* * * * *